United States Patent [19]

Canazzi

[11] 3,934,538

[45] Jan. 27, 1976

[54] BOAT PROPULSION SYSTEM

[76] Inventor: H. Donald Canazzi, 178 Jewett Parkway, Buffalo, N.Y. 14214

[22] Filed: May 16, 1974

[21] Appl. No.: 470,408

[52] U.S. Cl. ..... 115/39; 114/16 G; 115/12 R

[51] Int. Cl.[2] ..... B63H 5/16

[58] Field of Search ..... 115/39, 35, 42, 11, 12 R, 115/14, 16; 114/16 G; 60/221, 222

[56] References Cited

UNITED STATES PATENTS

| | | | |
|---|---|---|---|
| 2,812,738 | 11/1957 | Munro | 115/39 |
| 3,306,046 | 2/1967 | Trapp | 115/12 R |
| 3,513,798 | 5/1970 | Dow | 114/16 G |
| 3,744,446 | 7/1973 | Gibbins | 115/39 |
| 3,793,980 | 2/1974 | Sherman | 115/39 |
| 3,823,684 | 7/1974 | Baggs | 115/39 |

*Primary Examiner*—Trygve M. Blix
*Assistant Examiner*—Stuart M. Goldstein
*Attorney, Agent, or Firm*—Oltman and Flynn

[57] ABSTRACT

A boat propulsion system having a downwardly-facing, openbottomed recess at the front of a circumferentially-enclosed propellor which accelerates the inlet water flow to the propellor without, however, requiring the water to change direction abruptly. A venturi throat just behind the propellor causes water to be drawn into the slipstream through auxiliary passages. A valve in the propellor discharge passage may be closed, so as to cause the water displaced by the propellor to flow through the auxiliary passages to produce a reverse thrust on the boat. Either auxiliary passage may be closed selectively. Arcuate rudders pivoted on opposite sides of the back end on the propellor discharge passage control the steering.

5 Claims, 13 Drawing Figures

FIG. 3
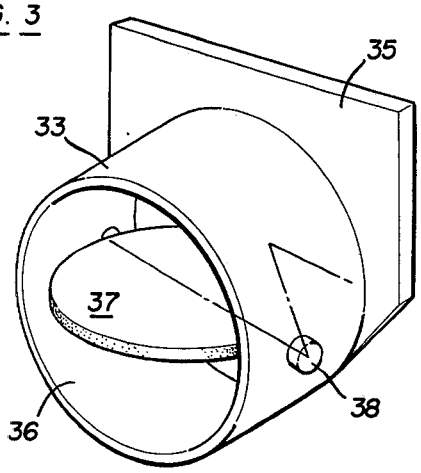
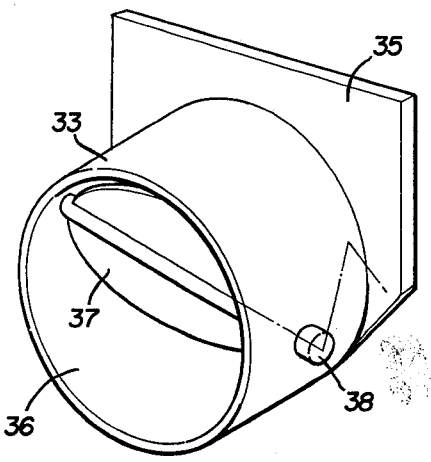
FIG. 4
FIG. 13
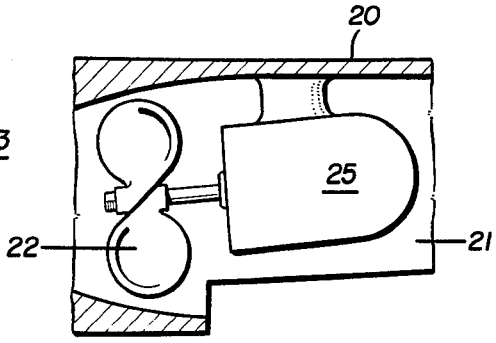
FIG. 5
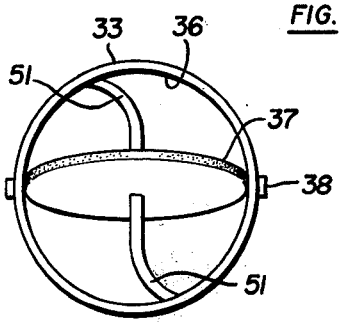
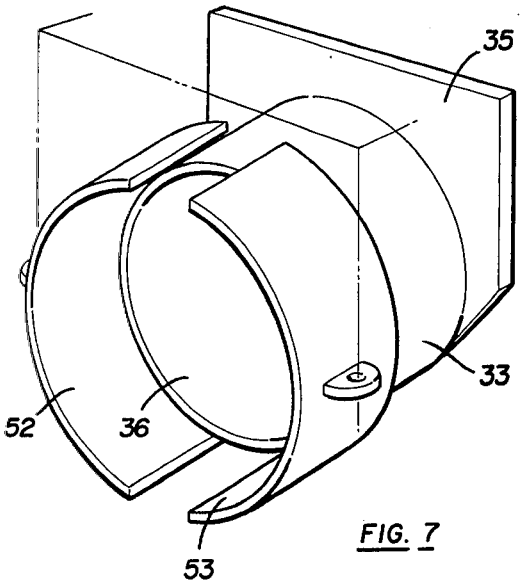
FIG. 7
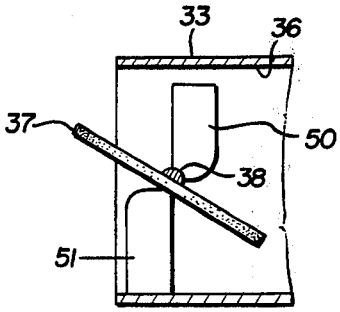
FIG. 6

BOAT PROPULSION SYSTEM

BACKGROUND OF THE INVENTION

In conventional propellor-operated boat propulsion systems, the centrigual movement imparted to the water by the rotating propellor tends to reduce the overall efficiency of the propulsion system. To offset this, various propellor shrouds have been proposed for circumferentially confining the water displaced by the propellor, but many such shroud arrangements have increased appreciably the drag on the boat.

In recent years boats have been provided with various jet propulsion systems which have the disadvantage that the water used for propulsion must undergo an abrupt change in direction, with a consequent waste of power.

SUMMARY OF THE INVENTION

The present invention is directed to a novel and improved boat propulsion system which largely overcomes the disadvantages of prior propellor-driven and jet propulsion systems.

In the present system, a downwardly-facing, open-bottomed recess on the bottom of the boat conducts water with progressively increasing velocity and without abrupt change in direction to the inlet side of a propellor. The propellor is circumferentially enclosed in a passage having a venturi throat close behind the propellor. The venturi action of the water displaced by the propellor draws in water through auxiliary passages to increase the effectiveness of the slipstream in propelling the boat forward. A valve in the discharge passage behind the propellor may be closed, causing the water displaced by the propellor to flow through the auxiliary passages and be discharged forwardly to produce a reverse thrust on the boat. Either auxiliary passage may be closed, in which case the flow of the propeller-displaced water through the other will produce a turning thrust on the boat. Pivoted arcuate rudders at the back end of the propellor discharge passage act to confine the slipstream and they effectively determine the steering of the boat. Preferably, the valve in the propellor discharge passage has vertical stabilizers which reduce swirling of the slipstream.

It is a principal object of this invention to provide a novel and improved boat propulsion system.

Another object of this invention is to provide a novel propellor-operated boat propulsion system which substantially avoids any abrupt change in the direction of the water displaced by the propellor.

Another object of this invention is to provide a novel propellor-operated boat propulsion system in which an open-bottomed water intake recess provides a positive flow of water to the inlet side of the propellor.

Another object of this invention is to provide a novel propellor-operated boat propulsion system in which the water displaced by the propellor produces a venturi action for drawing in additional water to the slipstream behind the propellor.

Another object of this invention is to provide a novel propellor-operated boat propulsion system which is readily reversible in a novel and convenient manner.

Further objects and advantages of this invention will be apparent from the following detailed description of certain presently-preferred embodiments thereof, which are illustrated in the accompanying drawings, in which:

FIG. 3 is a perspective view showing the back end of the propellor discharge passage in this propulsion system, with the valve therein in its fully-open position;

FIG. 4 is a view similar to FIG. 3, but showing the valve almost fully closed in the propellor discharge passage;

FIG. 5 is an end view looking into the propellor discharge passage having a valve therein with vertical stabilizers;

FIG. 6 is a longitudinal section through the propellor discharge passage in FIG. 5;

FIG. 7 is a perspective view showing pivoted, arcuate rudders on the back end of the propellor discharge passage;

FIG. 13 is a fragmentary longitudinal section showing the inboard-outboard mounting of a propellor in the present boat propulsion system.

Before explaining the disclosed embodiments of the present invention in detail, it is to be understood that the invention is not limited in its application to the details of the particular arrangements shown, since the invention is capable of other embodiments. Also the terminology used herein is for the purpose of description and not of limitation.

Figure 1:
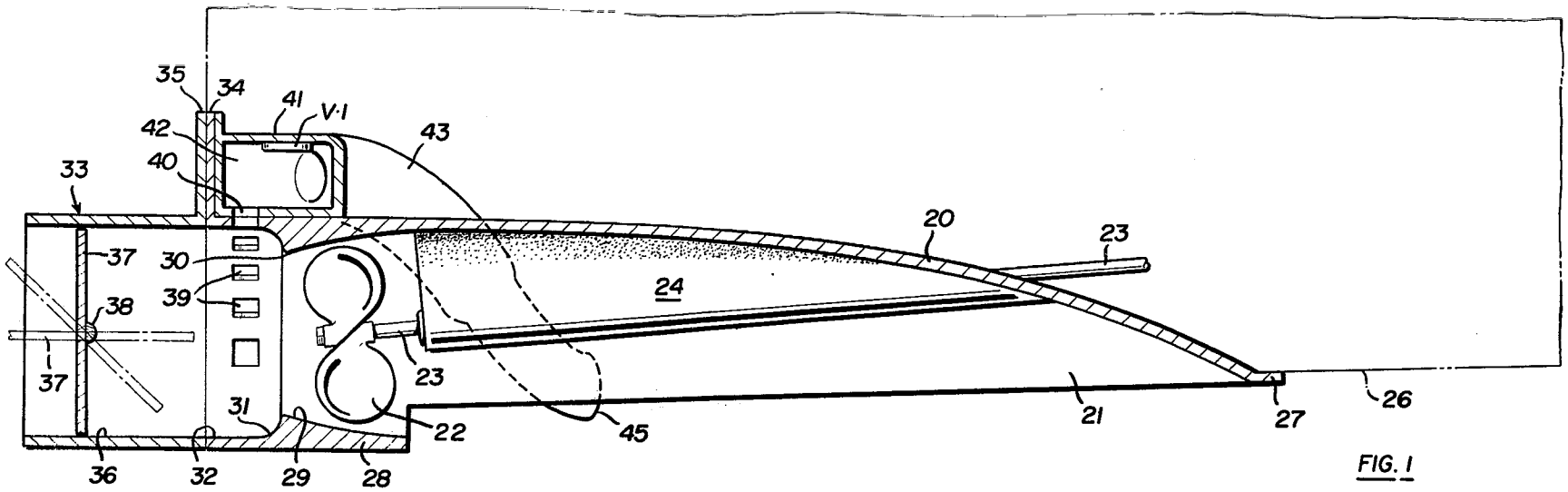
FIG. 1 is a fragmentary longitudinal sectional view taken at the stern of a boat along the bottom, along the line 1 — 1 in FIG. 2, showing the principal parts of the present propulsion system.
Figure 2:
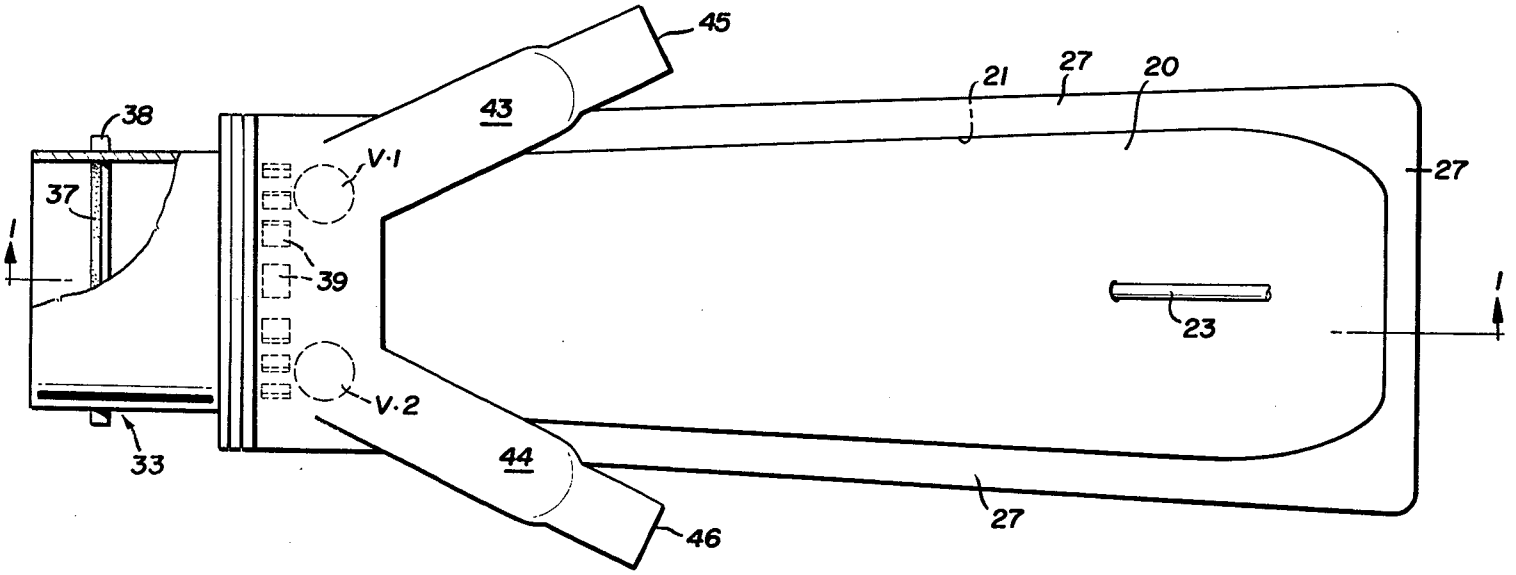
FIG. 2 is a top plan view of the propulsion arrangement shown in FIG. 1.

Referring to FIGS. 1 and 2, in the propulsion system of the present invention a casting 20 on the bottom of the boat toward the stern provides a downwardly-facing, open bottomed recess 21 that extends lengthwise centrally along the bottom of the boat to a propellor 22. The propellor is on a shaft 23 that is driven by the boat engine (not shown). The shaft extends through a longitudinal streamlined fin 24 on the casting 20 that extends down into the recess 21. The fin 24 encloses the propellor shaft 23 for most of the latter's extent inside the casting 20 to avoid the additional drag on the boat that a rotating shaft would exert if exposed to the water in the recess 21.

Alternatively, as shown in FIG. 13, the propellor may be driven through a conventional inboard-outboard drive having a streamlined housing 25 attached to the roof of the casting 20 near the rear end of the latter's open-bottomed recess 21.

As best seen in FIG. 1, the curved top of the casting 20 at the front end of the recess 21 extends at an angle of not more than 25 degrees to the bottom surface 26 of the boat immediately in front of it, so that there is no abrupt change of direction for the water entering this recess as the boat moves forward in the water. Rearward from the front end of its recess 21 the top of the casting 20 curves very gradually to extend substantially horizontal for most of its extent.

As shown in FIG. 2, the casting 20 has a marginal, substantially horizontal lip 27 extending along its opposite sides and at its front end. This lip engages directly beneath the bottom surface 26 of the boat at these locations. At each side the casting 20 curves upward gradually from this marginal lip 27. The lateral width of the recess 21 (from side-to-side transverse to the longitudinal axis of the boat) gradually decreases rearward along the casting 20, so that the rearwardly-flowing water in this recess gradually increases in velocity as it approaches the propellor but without undergoing any significant directional change. The velocity increase is accompanied by a pressure decrease, and the pressure differential insures a continual flow of water rearwardly to the propellor. The positive water pressure against the inlet side of the propellor insures that the propellor is not required to suck water.

The propellor is enclosed circumferentially by an annular shroud 28 (FIG. 1) which is an integral part of the casting 20 that provides the downwardly-facing recess 21. This shroud provides a passage 29 which closely surrounds the propellor 22 and is of gradually decreasing diameter rearwardly to an inwardly projecting, rounded lip 30. Immediately behind this lip 30 the passage diameter increases abruptly at 31 and then merges smoothly with a uniform diameter cylindrical portion 32 of the passage that is substantially the same size as the largest diameter portion of the passage 29 at the entrance side of the propellor.

A separately formed casting 33 is attached to the back end of casting 20 at their respective abutting, upstanding end flanges 34 and 35. This casting 33 presents a uniform diameter passage 36 that is an elongated extension of the uniform diameter portion 32 of the passage provided by the propellor shroud 28. A flat, plate-like, circular valve member 37 is pivoted on a horizontal axis 38 for movement between a vertical position in which it completely closes the passage 36 and a horizontal position in which it opens this passage as fully as possible.

The passage 29–32 in the propellor shroud 28 provides a venturi throat at lip 30, a converging passage portion 29 at the inlet side of this throat, and a diverging passage portion 31 at the outlet side of the throat. Consequently, water flowing through this passage undergoes a progressive increase in its velocity as it approaches the venturi throat, and at the outlet side of this throat it undergoes a progressive decrease in its velocity and an increase in its pressure.

The propellor shroud has a plurality of circumferentially spaced openings 39 that are located close enough behind the lip 30 to be subjected to the venturi action of the water displaced by the propellor. That is, the water displaced by the propellor and flowing longitudinally through the passage 32, 36 tends to draw water in through the openings 39 when the valve 37 in passage 36 is open.

These openings 39 register with corresponding openings 40 formed in a hollow, generally C-shaped housing 41 that straddles the rear end of the casting 20. This housing presents a water-receiving chamber 42 outside the openings 40.

A pair of tubes 43 and 44 extend down from the chamber 42 on opposite sides of the casting 20, as best seen in FIG. 2. These tubes terminate at their lower ends in forwardly-facing openings 45 and 46, respectively, located at the bottom of the boat and forward beyond the propellor 22 for either taking in water or discharging it, as explained hereinafter. These openings 45 and 46 are inclined laterally outward at an angle on the order of 35 degrees to the centerline of the boat.

At the upper end of each tube 43 and 44, where it communicates with the chamber 42, is located a respective valve V-1 or V-2, which may be closed to block off the upper end of the respective tube. In FIG. 1 the valve V-1 is shown schematically as simply a pivoted plate, but it is to be understood that any suitable valve construction may be provided. Each of the valves V-1 or V-2 may be closed or opened individually through a suitable control linkage operated by the pilot of the boat.

In the use of the propulsion system as thus far described, for normal operation of the boat in a forward direction the valve 37 in the propellor discharge passage 36 is fully open and the valves V-1 and V-2 for tubes 43 and 44 are fully open. The venturi action of the water displaced by the propellor 22 draws water up through the auxiliary passages provided by the open-ended tubes 43 and 44 and through the openings 39 into the discharge passage. This venturi action increases the mass of water flowing toward the rear of the boat through the discharge passage 36 and thereby increases the effectiveness of the slip-stream in propelling the boat forward.

If the discharge valve 37 is closed and valves V-1 and V-2 are open, the water displaced by the propellor will flow out through the openings 39, 40 into the chamber 42 and then down and forward through the auxiliary passages provided by the tubes 43 and 44. The water is discharged at the forwardly-facing openings 45 and 46 at the lower ends of these auxiliary passages to produce a rearward thrust on the boat.

If the discharge valve 37 is closed and one or the other auxiliary passage valves V-1 or V-2 is closed, the flow of water down through the other (open) laterally-inclined auxiliary passage will produce a turning thrust on the boat.

If desired, with valves V-1 and V-2 open, the valve 37 may be turned to a partly-closed position in which forward and reverse thrusts on the boat are balanced while the engine power is increased. Then, when valve 37 is opened fully or closed fully, a very quick forward or reverse movement of the boat is obtained.

Referring to FIGS. 5 and 6, the valve 37 in the propellor discharge passage 36 preferably carries upper and lower stabilizer fins 50 and 51. These fins extend transverse to the valve 37 and are disposed respectively on opposite sides of the latter's pivot 38 in a direction lengthwise of the boat. At their respective inner ends, immediately adjacent the valve 37, the stabilizer fins extend substantially perpendicular to it. Their outer ends, however, are curved circumferentially in the same direction (counterclockwise in FIG. 5). These stabilizer fins 50 and 51 reduce the swirling of the water that is displaced into the discharge passage 36 by the propellor 22, and they tend to maintain a coherent stream of water flowing longitudinally of this passage for maximum effectiveness in propelling the boat. If desired, the opposite edges of the valve 37 may be curved circumferentially in the same direction for enhancing this effect.

As shown in FIG. 7, preferably a pair of arcuate rudders 52 and 53 are pivoted on opposite sides of the open back end of the discharge passage 36 in the body 33 for angular adjustment in unison about respective vertical axes. The pivoted mountings of these arcuate rudders and the actuating mechanism for turning them are omitted from FIG. 7 for simplicity since these details are not a significant part of the present invention. These rudders are concave toward each other, and their concave inner faces conform closely to the cylindrical outside surface of the body 33 at the discharge passage 36. Each rudder has an appreciable arcuate extent, and together they tend to confine the slipstream laterally as it emerges from the discharge passage 36. The rudders are directly exposed to opposite sides of the slipstream for maximum steering effectiveness.

Figure 8:
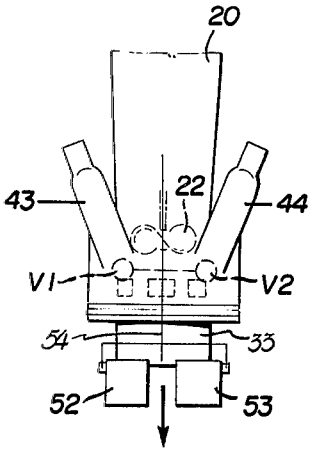
FIGS. 8, 9 and 10 are top plan views showing the present propulsion system with the arcuate rudders of FIG. 7 in different steering positions.
Figure 9:
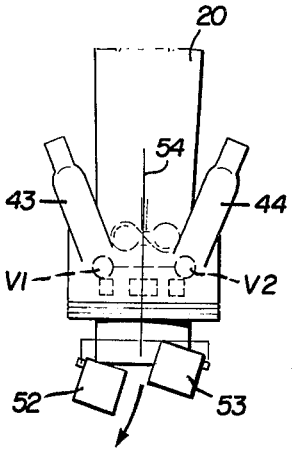
Figure 10:
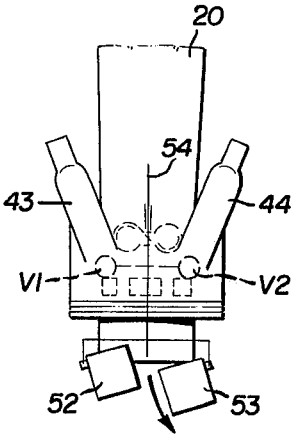

As shown in FIGS. 8, 9 and 10, the rudders 52 and 53 may extend straight back or they may be tilted at an angle in either direction laterally to direct the slipstream accordingly and thereby steer the boat.

Preferably, the valves V-1 and V-2 at the upper ends of the auxiliary passages provided by the tubes 43 and 44 may be operated by the same control linkage as the rudders 52 and 53 in the following manner:

a. when the rudders extend straight back (FIG. 8) both valves V-1 and V-2 are open, and water is drawn up through both auxiliary passages;

b. when the rudders are tilted clockwise, viewed from above (FIG. 9), valve V-1 is closed and valve V-2 is open, and the water drawn up through tube 44 produces an additional counterclockwise component of thrust on the boat; and c. when the rudders are turned counterclockwise (FIG. 10), valve V-2 is closed and valve V-1 is open, and the water drawn up through tube 43 produces an additional clockwise component of thrust on the boat.

The control linkage for valves V-1 and V-2 and the slipstream rudders 52 and 53 is designated schematically by the dashed line 54 in FIGS. 8, 9 and 10.

Figure 11:
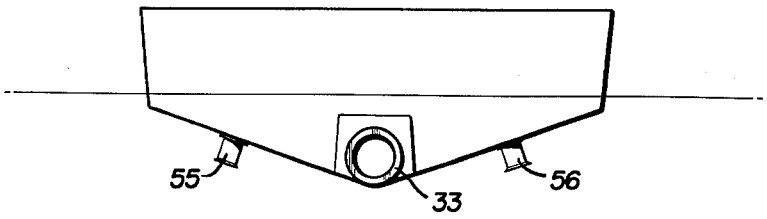
FIG. 11 is a rear elevational view of a boat having stabilizers operated hydraulically from the present propulsion system.
Figure 12:
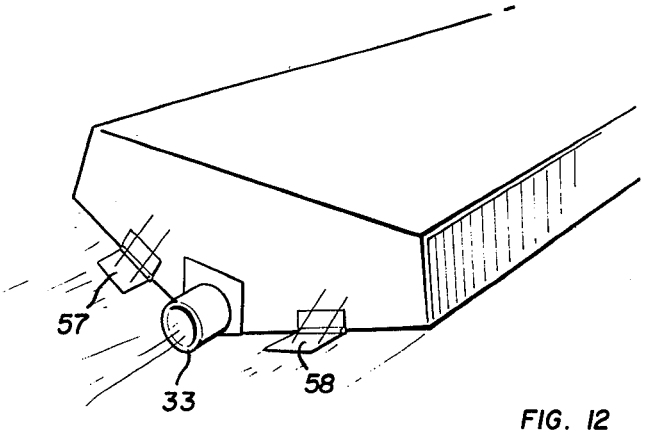
FIG. 12 is a perspective view showing a boat provided with trim tabs operated hydraulically from the present propulsion system.

With the present propulsion system, water may be diverted from the slipstream flowing through the discharge passaage 36 to operate stabilizers 55 and 56 (FIG. 11) or pivoted trim tabs 57 and 58 on the stern of the boat (FIG. 12) for adjusting the running angle of the boat under various conditions of weight distribution and speed. Alternatively, the water pressure in chamber 42 (FIG. 1) may be used for such purposes so that a separate power source for operating these accessories will not be required.

I claim:

1. In a propulsion system on a boat having:

means defining a downwardly-facing, open-bottomed recess extending lengthwise along the bottom of the boat and gradually converging to provide a progressively smaller cross-section rearwardly; the improvement which comprises:

an annular shroud defining a passage that is closed at the bottom of the boat and merges smoothly with the back end of said open-bottomed recess and provides a rearward extension of said recess, said passage presenting a venturi throat and having an abruptly increased cross-section behind said throat and terminating in an open back end;

a propellor circumferentially enclosed in said passage just in front of said venturi throat;

means defining one or more openings in said shroud leading into said shroud immediately behind said venturi throat;

auxiliary passage means open at one end thereof to the outside of the boat and communicating at the other end thereof through said openings with the interior of said shroud immediately behind said venturi throat for passing water into said shroud by the venturi action of the water displaced through said throat by the propellor;

said recess providing substantially horizontal and non-turbulent flow of intake water along the bottom of the boat with gradually increasing velocity to the inlet side of the propellor;

and a plate-like valve member in said shroud behind said openings, said valve member being pivoted and movable between an open position substantially parallel to the direction of water flow from said propellor through said shroud and a closed position substantially transverse to said direction.

2. A boat propulsion system according to claim 1, and further comprising a pair of stabilizers extending transverse to said plate-like valve member on opposite sides of the latter to extend upward and downward, respectively, in said first-mentioned passage when said valve member is in its open position.

3. A boat propulsion system according to claim 2, wherein said stabilizers have their outer ends curved circumferentially in the same direction.

4. In a propulsion system on a boat having:

means defining a downwardly-facing, open-bottomed recess that extends lengthwise along the bottom of the boat, said recess converging rearwardly;

and a propeller at the back end of said recess; the improvement which comprises:

a shroud enclosing said propeller circumferentially and defining a discharge passage with a venturi throat behind the propeller, said discharge passage having an abruptly increased cross-section behind said throat, said shroud having openings therein behind the propeller for passing water into said discharge passage by the venturi action of the water displaced into said discharge passage by the propeller;

means defining one or more auxiliary passages, each having a forwardly-facing, open, front end located forward of said propeller;

means for providing fluid communication between the rear end of each of said auxiliary passages through said openings to the interior of said shroud for passing water into said discharge passage by the venturi action of the water displaced into said discharge passage by the propeller;

and a plate like valve member in said shroud behind said openings and movable between an open position substantially parallel to the direction of water flow from said propeller rearward and a closed position transverse to said direction.

5. A boat propulsion system according to claim 4, wherein there are two of said auxiliary passages located respectively on opposite sides of said venturi throat, and a valve in each auxiliary passage controlling the flow of water therethrough to determine the direction of the boat's movement when said valve means closes said discharge passage behind the propeller.

* * * * *